United States Patent [19]

Thompson

[11] 3,945,490

[45] Mar. 23, 1976

[54] COVERED ARTIST PALETTE APPARATUS

[76] Inventor: Vivienne J. Thompson, 2248 S. Lakeshore Drive, Clermont, Fla. 32711

[22] Filed: Oct. 31, 1974

[21] Appl. No.: 519,417

[52] U.S. Cl. ..... 206/1.7; 206/72; 220/306

[51] Int. Cl.[2] B05C 17/00; B44D 3/04; B65D 43/10

[58] Field of Search ..... 206/1.7, 1.8, 72, 451; 220/307, 306

[56] References Cited

UNITED STATES PATENTS

| | | | |
|---|---|---|---|
| 506,160 | 10/1893 | Connolly | 206/451 |
| 2,090,083 | 8/1937 | Wallace | 206/1.7 |
| 2,165,345 | 7/1939 | Conway, Jr. et al. | 206/1.8 |
| 2,711,605 | 6/1955 | Dripps | 206/1.7 |
| 2,923,081 | 2/1960 | Simmons | 206/1.7 |
| 3,233,775 | 2/1966 | Bozek | 220/307 |
| 3,744,663 | 7/1973 | Moren | 220/306 |

*Primary Examiner*—William T. Dixson, Jr.
*Attorney, Agent, or Firm*—Duckworth, Hobby & Allen

[57] ABSTRACT

An artist palette is provided which is easily held by the artist during mixing and applying paints and which may have a pad of disposable sheets of material carried thereon for mixing the paints upon. The palette has a removable cover which holds the palette pad in place and a cap for sealing the opening for holding the palette whereby the drying of mixed paint can be slowed for later use. The palette is designed to be easily stacked in a class or carried about by the artist.

6 Claims, 3 Drawing Figures

31
38
40
37
33
32
34
36
35
20
23
30
21
10
15
14
13
17
25
24
18
16
27
28
26

COVERED ARTIST PALETTE APPARATUS

BACKGROUND OF THE INVENTION

The present invention relates to artist palettes and especially to enclosable artist palette for mixing paints upon.

In the past, a great variety of shapes and designs have been provided for artist palettes in which an artist can hold a palette with one hand by placing a thumb through an opening in the bottom thereof and gripping the palette for mixing the paints and for holding the mixed paints for application to a surface being painted upon. In recent years, palette pads have been provided in which a pad of disposable sheets are attached to a more rigid support member and the sheets and support member are shaped for supporting in the same manner as a palette. Each sheet is used for mixing paints upon and is then torn off and thrown away, to avoid the bother of cleaning a more permanent surface palette. However, many times paint and especially oil base paints can be used for several days once mixed and is sometimes difficult to mix up the same color once the used paints are disposed of. It has been suggested to provide palettes and paint boxes with covers to protect the paints from drying so that once mixed they may be used for several days in a row until they are used up. These containers for holding paint are sometimes attached to palettes, such as in U.S. Pat. No. 3,188,036 for a PAINT RECEPTACLE FOR USE WITH ARTIST'S PALETTES in which paint receptacles are attached directly to a palette and having a top for sealing each receptacle, and in U.S. Pat. No. 3,278,007 for a MULTICOLOR PAINT KIT in which the paints are not connected to the palette but a paint box has a top with a plurality of closures for closing a plurality of paint receptacles simultaneously. U.S. Pat. No. 2,473,532 teaches a paint box and may also be utilized as a palette in which the top swings around to form the palette while the bottom acts as a paint brush storage kit. U.S. Pat. No. 2,711,605 for a PALETTE AND PIGMENT HOLDER teaches a disposable pad of palette surfaces having a pigment holder attached thereto for holding a plurality of different pigments which are covered so that the pigments may be utilized directly onto the disposable palette sheets. U.S. Pat. NO. 3,428,167 for an ARTIST'S PALETTE teaches an artist palette which may be slid into an envelope cover storing the palette and artist's brushes while U.S. Pat. No. 2,563,455 teaches a container for holding a plurality of receptacles. U.S. Pat. No. 3,280,966 teaches a PALETTE AND PAINT KIT having a removable cover which is used as a palette and which provides storage for brushes and paints, which paints can be covered when not being used. The present invention on the other hand provides an inexpensive artist palette which can be easily covered and stacked when not in use, such as in the art class and which may be sealed sufficiently to maintain oil base paints for several days and which may hold paint brushes and palette pads of disposable sheets without the mixed paints coming in contact with the palette cover.

SUMMARY OF THE INVENTION

An artist palette is provided having a palette base having a flat portion with sides with paint cups and a space for holding brushes formed into the flat portion of the palette base. The base has raised rimmed edges for holding a removable palette pad of layers of paper sheet material. The palette base has a thumb hole opening therethrough for holding the base and a removable cap for covering the opening when the palette is not in use. The cover is shaped to fit over the palette base for removable attachment thereto. The cover has sides to fit over the sides of the base and a ledge extending over the raised rim and over a portion of a removable palette pad placed on the base to hold the palette pad when the cover is attached to the palette base. The cover also has additional sides extending from the ledge to form a raised cover portion to prevent contact with any paints on the top layer of the palette pad. The cover is attached to the base by matching grooves on the cover side and base side and tabs are provided for snapping the cover off.

BRIEF DESCRIPTION OF THE DRAWINGS

Other objects, features and advantages of the present invention will be apparent from the written description and the drawings in which.

DESCRIPTION OF THE PREFERRED EMBODIMENT

Figure 1:
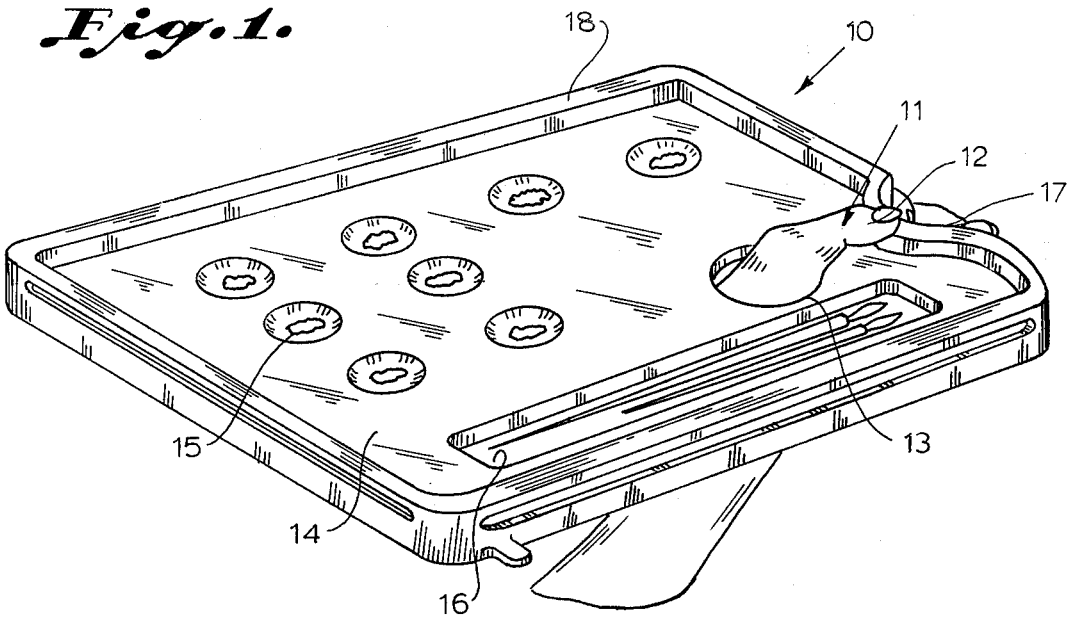
FIG. 1 is a perspective view of the palette base being held by an artist's hand.
Figure 2:
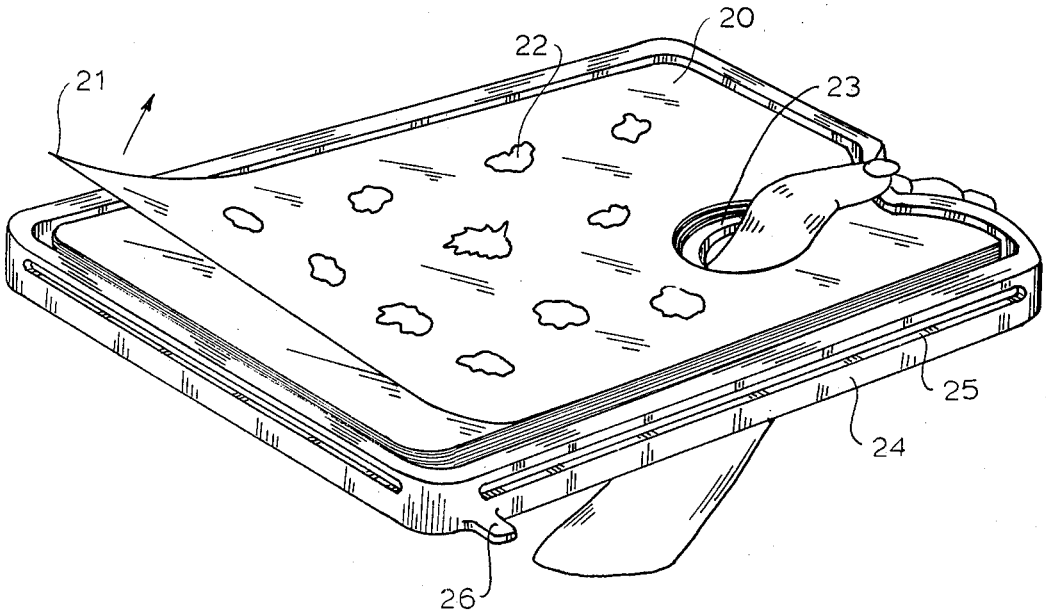
FIG. 2 is a palette base having a removable, disposable palette pad thereon for painting upon.

Referring now to FIGS. 1 and 2, an artist palette 10 is illustrated being held by a hand 11 having a thumb 12 protruding through an opening 13 in the palette base. The palette 10 has a flat base portion 14 with a plurality of paint cups or receptacles 15 formed therein and a rectangular recessed area 16 for holding artist paint brushes. In addition to the opening 13, the palette has a curved finger gripping portion 17 for gripping the palette while painting or mixing paints. The palette 10 also has a raised rim 18 which conveniently allows a palette pad 20 having a plurality of disposable palette sheets 21 for mixing paints 22 upon the top sheet which may then be torn off and disposed of and the next sheet used, thereby avoiding the messy clean ups, especially when using oil base paints. The pad 20 conveniently has an opening 23 therethrough at the same position as the opening 13 and is shaped the same general shape as the palette 10 to fit within the raised rim 18 of the palette base 10 which holds the disposable palette sheets in place during mixing and painting. The palette can be conveniently made of easily vacuum-formed plastics for inexpensive and rapid manufacture and includes four sides 24 each having recessed grooves 25 therein and at least one protruding tab 26. Grooves 25 and tab 26 are for attaching and removing a cover that fits over the palette 10 as will be described in connection with FIG. 3. It should be clear in the present invention that the receptacles 15 can be used for storing pigment to be mixed or can be used for mixing paints for use as a palette which is cleaned after each use especially in the case of water base paints which are more easily cleaned from the plastic surface 14.

Figure 3:
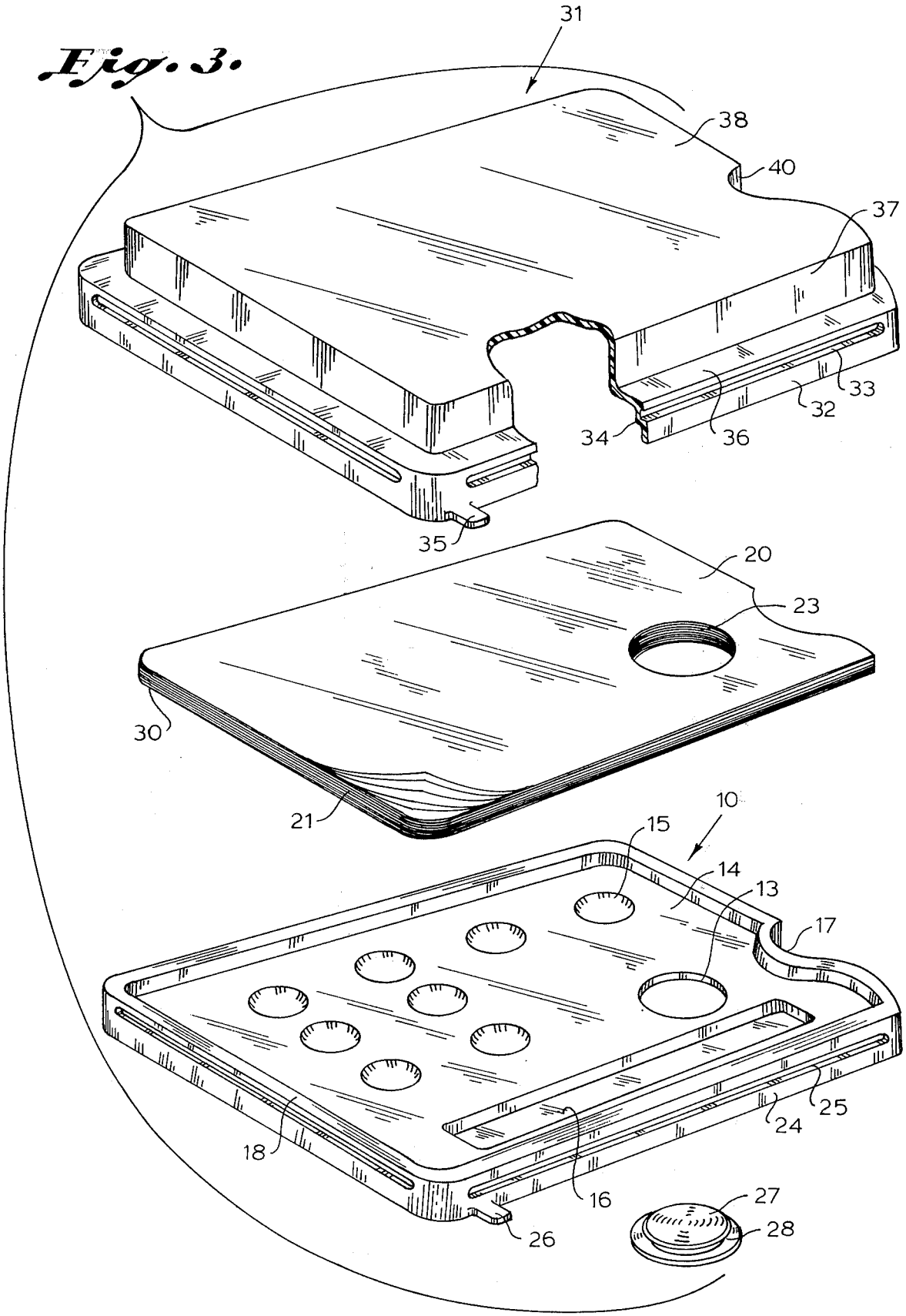
FIG. 3 is an exploded perspective view of an artist's palette including the cover, disposable pad, palette base and base covering cap.

Referring now more specifically to FIG. 3, the palette base 10 is illustrated having the opening 13 which as a removable rubber cap 27 with an annular groove 28 therein for engaging the edge of the opening 13 for sealing the opening when the palette is not in use. The palette also has the receptacles 15 formed into the base 14 along with the sides 24 having a plurality of recessed, elongated grooves 25 and a tab 26. A paint brush recessed area 16 is provided along with the curve portion 17. The disposable sheet palette pad 20 is illustrated having a plurality of sheets 21 and has a base member 30 along with an opening 23 therethrough. The base member gives support for using the disposable palette pad 20 without the palette 10, if desired, but the palette 10 provides additional support and is conveniently situated to fit within the raised rim 18 which holds it in place during use and during storage. A cover 31 has a plurality of sides 32 with an elongated recessed groove 33 in each side which groove protrudes on the inside of the side 32 as illustrated at 34. The side also has at least one tab 35 for removing the cover 31 from the palette 10. The palette cover 31 has a wide ledge 36 extendidng all the way around the cover 31 and additional sides 37 extending from ledge 36 to form a raised surface 38. The palette cover has a curved portion 40 so as to conform to the shape of the base 10. Thus, a palette pad 20 can be placed on the base 10 in the raised rim 18. The cap 27 fitted in place in the opening 13 and the cover 31 placed on top of the base 10 completely enclose the palette 10. The protruding portion 34 of grooves 33 snap into the recessed portions of grooves 25 of the base 10 to lock or removably attach the cover 31 to the base 10 allowing the tabs 26 and 35 to be placed adjacent each other so that they may be gripped to pull the cover 31 from the base 10. These grooves conveniently allow a rapid connection and removal of the cover 31 thereby providing an attachment means which can be readily vacuum-formed into the palette and cover. The ledge 36 of cover 31 extends over and may press down against the rim 18 of the base 10 and is wide enough to extend over a portion of a palette pad 20 placed in the base 10 thereby holding the palette pad in place against the base. If a palette pad 20 has paints 22 upon the top sheet which are to be saved for the next painting session, these paints are conveniently held away from the raised top portion 38 of the cover 31 by the distance of the raised sides 37 and since the ledge 36 holds the pad down, the pad cannot flop onto the raised portion 38 if the palette is turned sideways or upsidedown thereby messing up the cover 31. The top 31 with the groove attachment and the sealing cap 27 conveniently seal the palette sufficiently to reduce the movement of air into the palette enclosure and thereby reducing the drying of the paint, especially oil base paints. The palettes are also designed with a raised cover 38 so that the recessed bottom portion of the palette 10 allows a plurality of covered palettes to be stacked one onto the other without messing up the paints in any one palette and may be easily removed, such as in a painting class where the palettes could be stacked each day after class and removed for the next class.

It should be apparent to those skilled in the art that an artist palette with the unique cover and features has been provided which can be made of any material desired but it should also be clear that the present invention is not to be construed as limited to the particular forms disclosed herein since these are to be regarded as illustrative rather than restrictive.

I claim:

1. An artist palette comprising:

a palette base having a flat portion and sides and an opening therethrough for grasping said base, said base having paint cups formed therein and a raised rim for holding a removable palette pad having a plurality of layers of sheet material, with said raised rim and said base forming a recessed area contoured to hold therein said removable palette pad;

a removable cap for covering said opening in said base when said palette is being stored;

a cover shaped to fit over said palette base, said cover having sides to fit over said base and sides and a ledge extending from said sides over said raised rim and over a portion of a removable palette pad placed on said base to hold said palette pad when said cover is attached to said palette base and said cover having additional sides extending from said ledge to form a raised cover portion whereby paint or the like on a palette pad will be held out of contact with said cover; and removable attaching means for attaching said cover to said palette base.

2. The artist palette in accordance with claim 1 in which said removable attaching means includes a plurality of elongated raised areas on the inside of the sides of said cover and a plurality of elongated recessed grooves on the outside of the sides of said palette base, said cover elongated raised portions adapted to fit into said recessed grooves on said palette base to attach said cover to said base.

3. The artist palette in accordance with claim 2 in which said base and said cover each have at least one protruding tab for separating said cover from said palette base.

4. The artist palette in accordance with claim 3 in which said palette and cover are made of a thermoplastic material.

5. The apparatus in accordance with claim 4 in which said removable cap is a circular rubber cap having an annular sealing groove therein for snapping into a circular opening in said palette base.

6. The apparatus in accordance with claim 5 in which said palette base includes an elongated recessed area for holding paint brushes.

* * * * *